US005640903A

United States Patent [19]

Salomon

[11] Patent Number: 5,640,903

[45] Date of Patent: Jun. 24, 1997

[54] METHOD AND APPARATUS FOR INITIATING PRINTING AND REGISTERING A MAILPIECE IN A STAND ALONE POSTAGE METER

[75] Inventor: James A. Salomon, Cheshire, Conn.

[73] Assignee: Pitney Bowes Inc., Stamford, Conn.

[21] Appl. No.: 580,692

[22] Filed: Dec. 29, 1995

[51] Int. Cl.[6] ..... B41L 47/46

[52] U.S. Cl. ..... 101/91; 400/579; 400/630; 271/227; 271/265.01; 209/900

[58] Field of Search ..... 101/91, 93; 400/579, 400/630, 708; 209/900; 271/227, 258.01, 259, 265.01, 265.02, 265.03, 261

[56] References Cited

U.S. PATENT DOCUMENTS

| | | | |
|---|---|---|---|
| 3,732,664 | 5/1973 | Blossom et al. | 53/57 |
| 3,948,170 | 4/1976 | Ericsson | 271/261 |
| 4,524,691 | 6/1985 | Miller | 101/232 |
| 4,733,226 | 3/1988 | Kasuya et al. | 209/900 |
| 4,739,606 | 4/1988 | Cantile | 53/493 |
| 4,742,771 | 5/1988 | Heilig | 101/407 |
| 4,744,554 | 5/1988 | Kulpa et al. | 271/251 |
| 5,035,415 | 7/1991 | Lee et al. | 271/259 |
| 5,172,907 | 12/1992 | Kalisiak | 271/227 |
| 5,302,948 | 4/1994 | Lau et al. | 209/900 |
| 5,322,012 | 6/1994 | Gartner et al. | 271/227 |
| 5,440,979 | 8/1995 | Bonham et al. | 101/91 |

*Primary Examiner*—Ren Yan

*Attorney, Agent, or Firm*—Steven J. Shapiro; Melvin J. Scolnick

[57] ABSTRACT

An apparatus for ensuring proper registration of a mailpiece in a feed path of a postage meter prior to printing includes a printing mechanism; detecting structure which detects first and second edges of the mailpiece in the feed path, the detecting structure initiating printing by the printing mechanism on the mailpiece at times when the first and second edges are concurrently detected in the feed path by the detecting structure and inhibiting printing by the printing mechanism at times when the first and second edges are not concurrently detected in the feed path by the detecting means. A method accomplishes the function of the apparatus.

10 Claims, 4 Drawing Sheets

METHOD AND APPARATUS FOR INITIATING PRINTING AND REGISTERING A MAILPIECE IN A STAND ALONE POSTAGE METER

BACKGROUND

This invention relates to an apparatus and method for ensuring proper registration of a mailpiece in a postage meter and more particularly to a method and apparatus for initiating printing and properly registering a mailpiece in a stand alone postage meter to ensure accurate orientation of a printed postal indicia on the mailpiece.

In a typical stand alone postage meter, a mailpiece (envelope, flat, etc.) is fed into the meter by hand rather than by use of an automatic feeder. When an edge of the mailpiece is detected by a trip sensor, the postage meter initiates printing under the assumption that tripping of the trip sensor by the mailpiece indicates that the mailpiece is properly registered relative to the printing mechanism so that a correctly oriented indicia image will be printed on the mailpiece. However, in conventional trip sensor structures for stand alone postage meters, the trip sensor is typically configured to detect the presence of a single edge of the mailpiece. Thus, if the mailpiece is presented in a skewed manner such that the trip sensor can still be tripped, the printed indicia image will be misaligned or perhaps, even worse, only part of the indicia image will be printed on the mailpiece. Moreover, if the mailpiece being presented to the postage meter is, for example, not very stiff, it may be bent as it is forced against a back registration wall of the postage meter. If the trip sensor is disposed in the back registration wall, it will be tripped to initiate printing. However, due to the bending of the envelope, its leading edge will be bowed and not properly registered against a leading edge registration wall. It is therefore possible that the top mailpiece surface upon which the indicia is to be printed will not be presented to the printing device in the proper orientation which is required to produce a properly aligned indicia image without smearing of the ink.

The problem discussed above concerning the relative positioning of the top of the mailpiece with respect to the printing mechanism becomes even more important in the case of an ink jet printer where maintaining, within tight tolerances, the distance between the printer nozzles and the top surface of the mailpiece is often critical to ensure that a good image is produced. Thus, as the postage meter industry moves toward using ink jet printers in postage meters, the need for ensuring that printing is only initiated when the mailpiece is properly registered becomes even more critical than in the past.

SUMMARY OF THE INVENTION

The instant invention is directed toward an apparatus and method for initiating printing and registering a mailpiece in a stand alone postage meter which overcomes the problems of the prior art set forth above.

The apparatus which accomplishes the above objective includes a printing mechanism; detecting structure which detects first and second edges of the mailpiece in the feed path of a postage meter, the detecting structure initiating printing by the printing mechanism on a mailpiece at times when the first and second edges are concurrently detected in the feed path by the detecting structure and inhibiting printing by the printing mechanism at times when the first and second edges are not concurrently detected in the feed path by the detecting means.

The method which accomplishes the above objective includes the steps of feeding a mailpiece into the postage meter; detecting first and second edges of the mailpiece; and only upon the concurrent detection of the first and second edges of the mailpieces initiating printing by the postage meter.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENT

Figure 1:
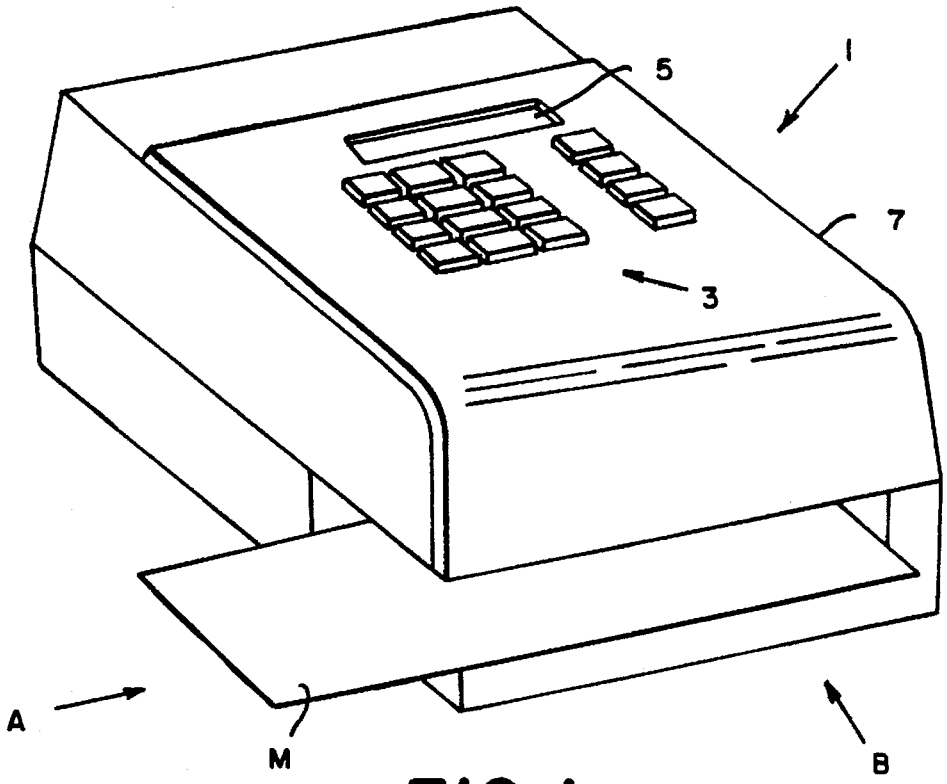
FIG. 1 is a perspective view of a stand alone postage meter incorporating the claimed invention.

Referring to FIG. 1, there is shown a postage meter 1. Mailpieces "M" (which for the purposes of this application include envelopes, labels, flats, etc.) are fed to postage meter 1 in either the direction of arrows "A" or "B" until a sensor (not shown), such as a microswitch or electro-optical through-beam sensor, is activated by movement of the mailpiece "M" thereby indicating the presence of the mailpiece "M". Upon identification of the mailpiece "M" by the sensor, printing of an indicia image by a conventional printing mechanism (drum/impression roller, platen/die, ink jet) is initiated as discussed in more detail below. Prior to printing, the operator will have entered the postage required via individual keypad buttons 3, and the electronics in the postage meter 1 will have verified that a particular postage transaction is permissible. Thus, once the transaction has been authorized, detection of the mailpiece "M" by the sensor triggers movement of the printing mechanism in a conventional manner. As noted in FIG. 1, a display 5 is disposed in a top cover portion 7 of postage meter 1. The display 5 permits the postage meter 1 to visually prompt any required input by the operator and to display the operator's input which has been entered through the keypad buttons 3.

Figure 2:
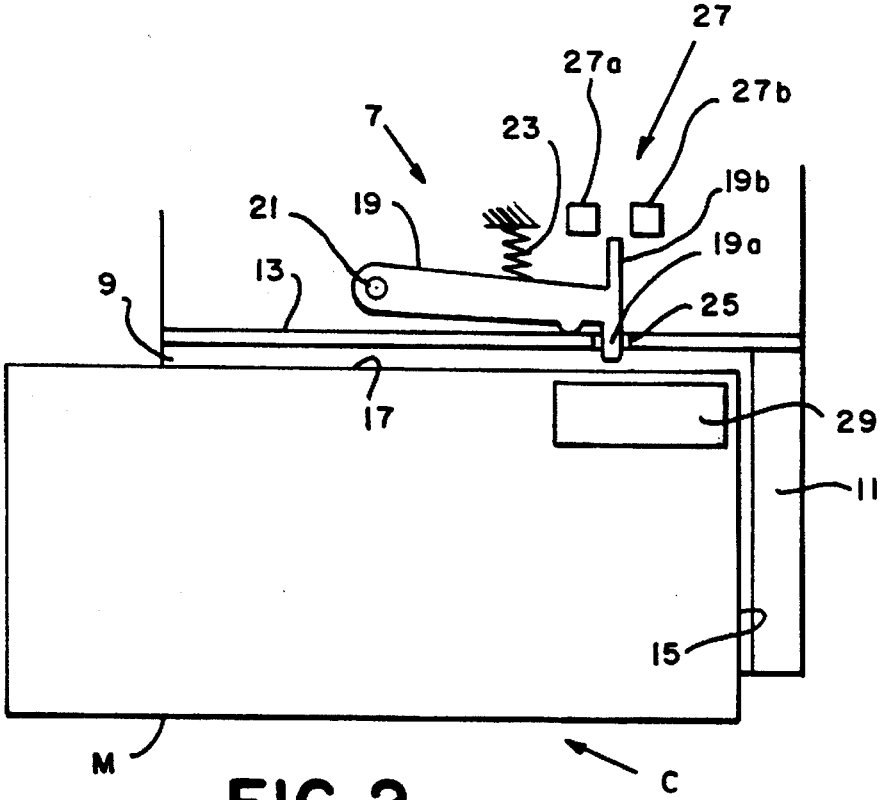
FIG. 2 (PRIOR ART)
FIG. 2 shows a conventional trip sensor structure.

FIG. 2 shows a conventional trip sensor structure 7 which has been implemented in stand alone postage meters. Only a deck portion 9, over which mailpiece "M" is fed by hand, of the postage meter is shown together with a leading edge registration wall 11 and a rear registration wall 13. In operation, mailpiece "M" is fed in the direction of arrow "C"

for registration within the postage meter via the contact of its leading edge 15 with registration wall 11 and the contact of its top edge 17 with registration wall 13. As top edge 17 is pushed toward registration wall 13, it first contacts an arm 19 at its projection 19*a*. Arm 19 is mounted in a conventional manner to pivot about point 21 and is biased by a spring 23 such that projection 19*a* extends through an opening 25 in registration wall 13. Thus, as mailpiece "M" is pushed against registration wall 13, arm 19 is forced to rotate in the counterclockwise direction of FIG. 2 against the force of spring 23 until a second projection 19*b* of arm 19 moves between a light producing element 27*a* and a light detecting element 27*b* of a conventional electro-optical through-beam sensor 27. Sensor 27 is connected in a known manner to a conventional microcontroller (not shown) of the postage meter and sends a signal to the microcontroller to indicate if the sensor beam is blocked or unblocked. As shown in FIG. 2, when the sensor 27 is not blocked printing is inhibited, but when sensor 27 is blocked the microcontroller initiates control of the printing mechanism in a known manner to print the indicia on mailpiece "M" in the region 29.

As further shown in FIG. 2, the placement of the trip sensor structure 7 in close relationship to registration wall 13 assumes that if the sensor 27 is blocked due to contact of the mailpiece "M" with projection 19*a*, then the mailpiece "M" is properly registered and printing is initiated. However, in this configuration, tripping of the trip sensor structure 7 does not always ensure proper registration. For example, if the mailpiece "M" is fed into the meter in a skewed manner it is possible to trip the trip sensor structure 7 such that printing on mailpiece "M" will be skewed. Moreover, and as previously discussed, if the mailpiece "M" is bowed as shown in FIG. 3, the top surface 28 of mailpiece "M" will also be bowed such that when it is printed upon the indicia image will be distorted and possibly smeared.

Figure 3:
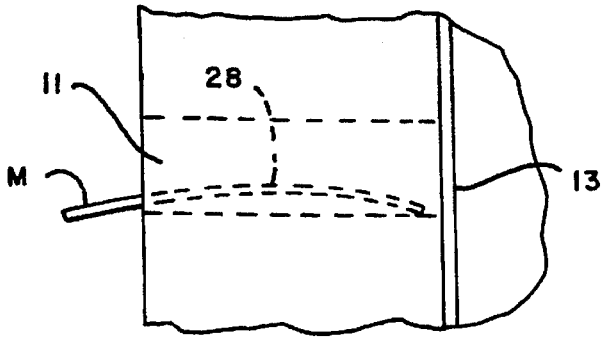
FIG. 3 shows a potential "bowing" of a mailpiece inserted into a postage meter.
Figure 4:
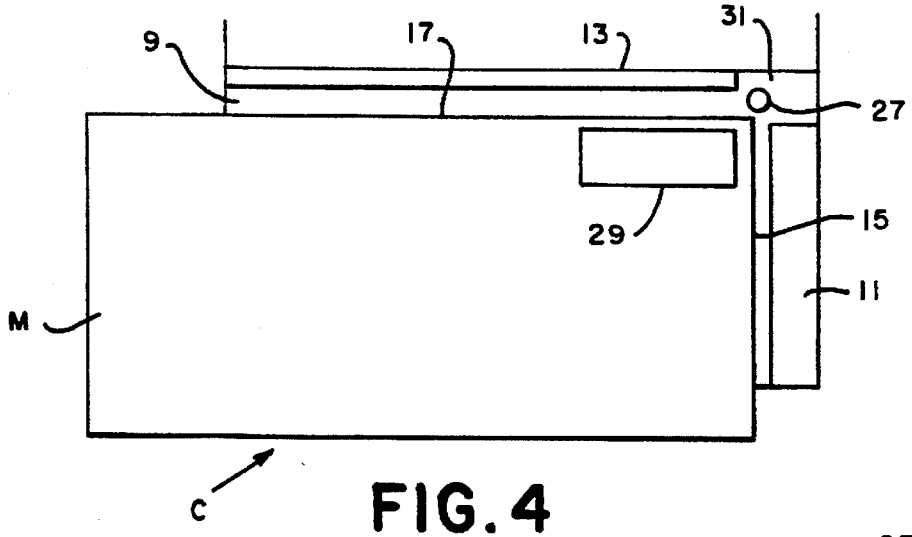
FIG. 4 shows a first trip sensor and registration structure.

FIG. 4 shows one possible solution which attempts to overcome some of the problems discussed above in connection with the prior art. In this application, sensor 27 is placed at the corner where the registration walls 11,13 would normally meet. However, portions of each registration wall 11,13 have been cut-away to define an opening 31 through which the corner of mailpiece "M" extends when edges 15, 17 are respectively pushed against registration walls 11,13. Thus, when the corner of the mailpiece "M" passes between the light producing element and light receiving element of sensor 27 it blocks the beam of light of sensor 27. The postage meter microcontroller then initiates printing based on the presence or absence of a signal from sensor 27 indicating the sensor's blocked condition. By positioning sensor 27 to detect the corner of mailpiece "M", there is a greater degree of confidence that the edges 15,17 are respectively aligned with registration walls 11,13. However, in this configuration if the mailpiece corner is bent or broken, the trip sensor 27 would never be tripped to initiate printing. Moreover, the problems associated with the bending of the mailpiece "M" as discussed in connection with FIG. 3 are also not prevented. Furthermore, paper dust associated with the mailpiece "M" can get deposited on sensor 27 preventing proper operation of sensor 27.

Figure 5:
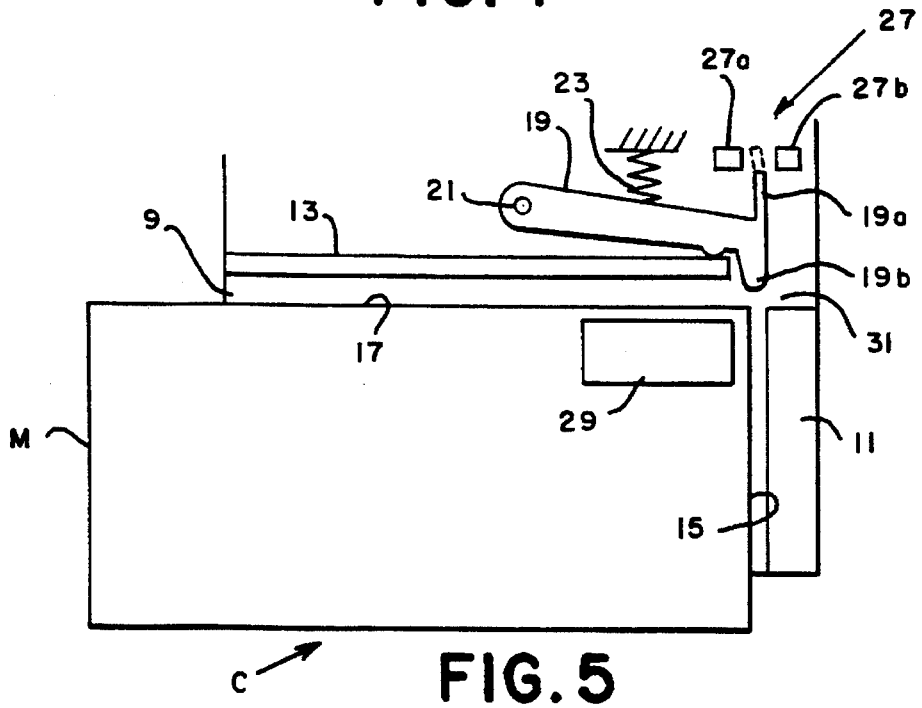
FIG. 5 shows a second trip sensor and registration structure.

In order to overcome the contamination problem associated with the sensor placement of FIG. 4, a trip sensor structure similar to that shown in FIG. 2 can be used but is positioned as shown in FIG. 5. The projection 19*b* is positioned at opening 31 such that as the corner of the mailpiece "M" moves against projection 19*b* the projection 19*a* is moved to its dashed line position of FIG. 5 to block the through-beam of sensor 27. This structure however is still susceptible to the problems discussed in connection with FIG. 3.

Figure 6:
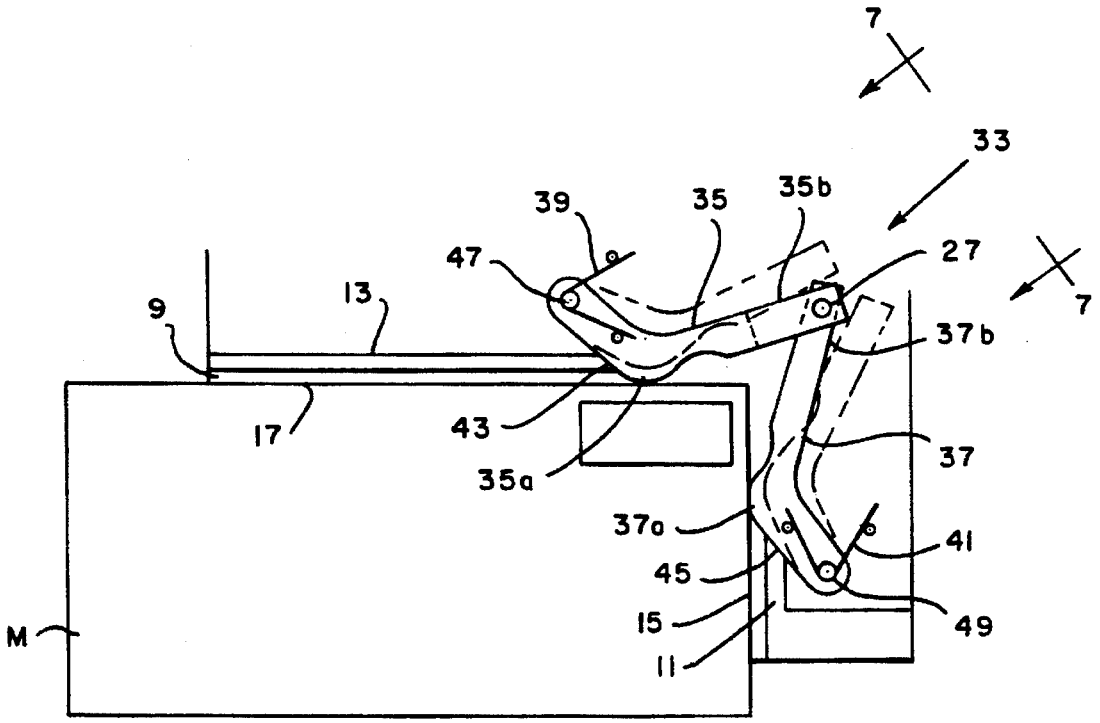
FIG. 6 shows a trip sensor and registration structure incorporating two pivoting sensor arms.

FIG. 6 shows a trip sensor structure 33 which overcomes, to a large extent, the mailpiece bowing problem of FIG. 3 and which provides greater accuracy in ensuring that the mailpiece is presented in an unskewed manner prior to initiating printing of the indicia. Trip sensor structure 33 includes two trip arms 35, 37 which are respectively biased by springs 39, 41 toward respective openings 43, 45 in registration walls 13, 11. Trip arm 35 has a projection 35*a* which extends through opening 43 in the normal biased position, while trip arm 37 has a projection 37*a* which extends through opening 45 in the normal biased position. In addition, an end portion 35*b* of trip arm 35 and an end portion 37*b* of trip arm 37 each extend between the light producing element 27*a* and the light detecting element 27*b* of through-beam sensor 27 (see FIG. 7) when trip arms 35, 37 are in the normal biased position shown in FIG. 6. As mailpiece "M" is pushed into the postage meter, its edges 15, 17 will respectively contact projections 37*a* and 35*a* of mailpiece "M" is properly registered. As mailpiece "M" is further pushed toward registration walls 13, 15 in an unskewed manner, trip sensor arms 35, 37 will each rotate about respective pivot points 47,48 toward their dashed line positions shown in FIG. 6. When mailpiece "M" has been positioned such that edges 15, 17 are respectively positioned against walls 11, 13, ends 37*b* and 35*b* will no longer block sensor 27. At this point in time, referring to FIG. 8, sensor 27 provides an indication to microcontroller 49 of its unblocked status and microcontroller 49 controls printing mechanism 50 to initiate printing on the mailpiece "M".

In the embodiment of FIG. 6, two edges of mailpiece "M" must be detected as being properly registered prior to initiating printing. In the event that mailpiece "M" is presented in a skewed manner such that only one of the trip arms 35, 37 is moved from between sensor elements 27*a* and 27*b*, the other trip arm will still block sensor 27 inhibiting printing. Thus, printing is only initiated when both edges 15, 17 are detected as being properly registered against walls 11,13.

The embodiment of FIG. 6 also overcomes the bowing problem discussed in connection with FIG. 3. That is, if mailpiece "M" is bowed as shown in FIG. 3, edge 15 will pass over and not contact projection 37*a*. Thus, end 37*b* will continue to block sensor 27 thereby preventing printing on the bowed surface 28.

Figure 7:
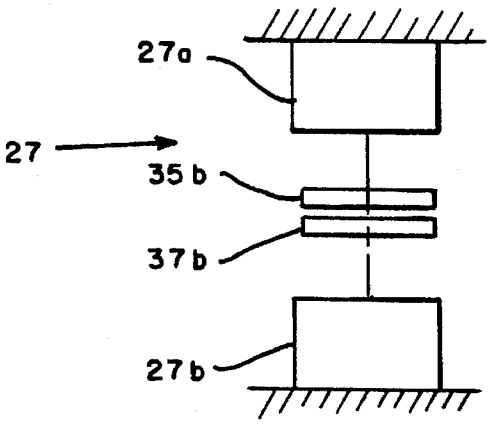
FIG. 7 is a partial end view of FIG. 6 taken along lines VI—VI.
Figure 8:
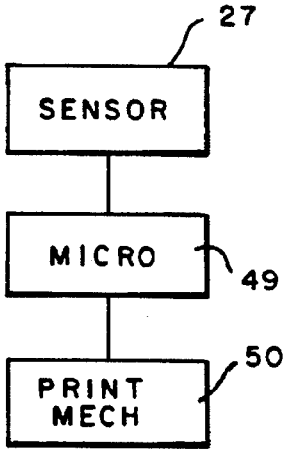
FIG. 8 is a schematic diagram of the printing control structure.
Figure 9:
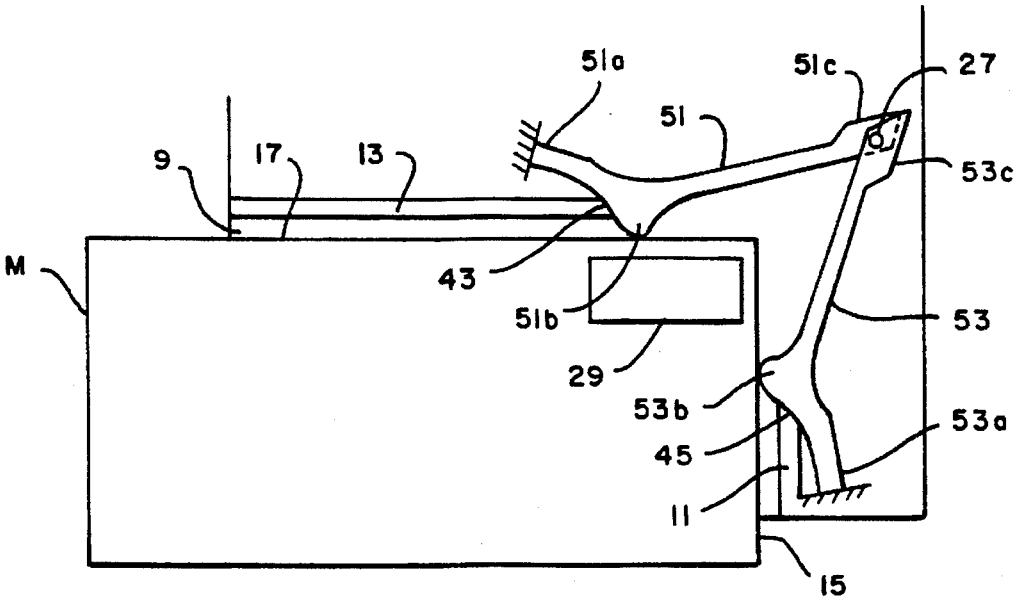
FIG. 9 shows a trip sensor and registration structure incorporating two flexible arms.

FIG. 9 shows another embodiment in which the spring/pivot/trip arm arrangement of FIG. 7 is replaced with a simpler structural arrangement. Flexible arms 51, 53 are fixedly mounted in a conventional manner at respective ends 51*a*, 53*a*. Arms 51, 53 have respective projections 51*b*, 53*b* which extend through respective openings 43, 45 in walls 13, 11. Additionally, ends 51*c*, 53*c* are normally positioned to block sensor 27. However, when the mailpiece "M" is pushed into the meter, edges 15, 17 thereof contact respective projections 53*b*, 51*b* forcing the flexible arms 51, 53 away from registration walls 13, 11 and into a final position where ends 51*c*, and 53*c* no longer block sensor 27. The embodiment of FIG. 8 therefore operates in basically the same manner as the embodiment of FIG. 7, except that the structure is greatly simplified. Moreover, it is to be noted that in both the embodiments of FIGS. 7 and 8 the single sensor 27 is blocked by both arms (35,37 or 51,53). However, individual sensors 27 associated with each arm could be used with printing only initiated when both sensors are unblocked (or blocked).

Figure 10:
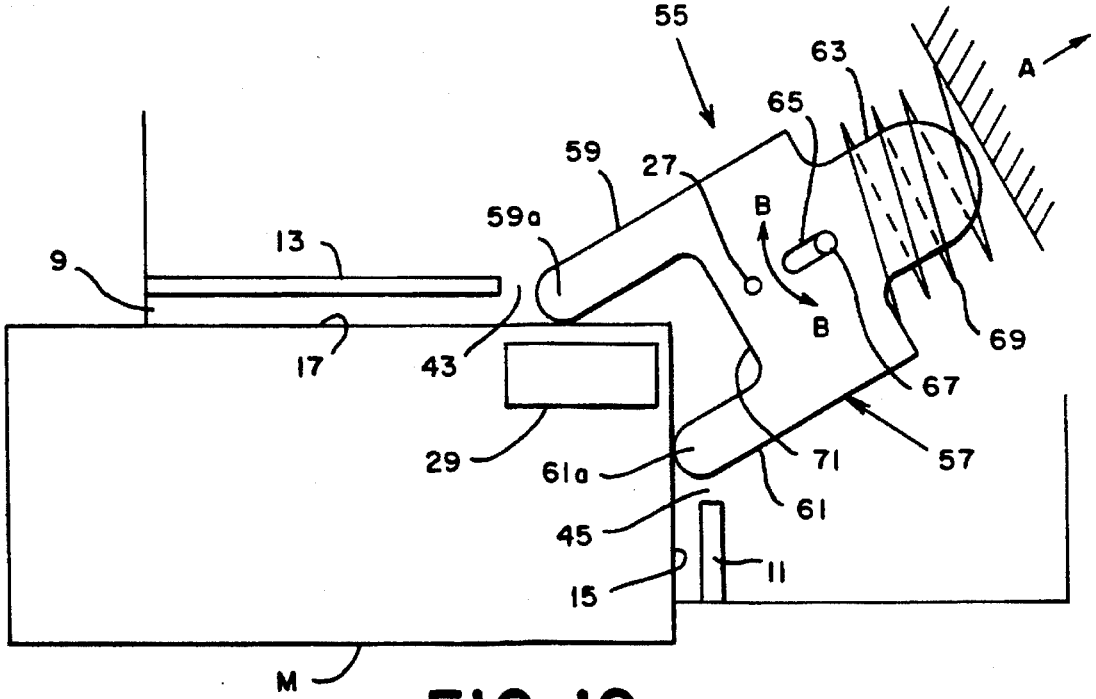
FIG. 10 shows a trip sensor and registration structure incorporating a trip device that is capable of linear and rotational movement.

FIG. 10 shows yet another embodiment of the invention incorporating trip sensor structure 55. Trip sensor structure 55 includes a body member 57 having a U-shaped portion including fingers 59, 61, a boss 63, and an elongated slot 65. Body member 57 is disposed around a fixed post 67 which is positioned within slot 65. Moreover, a spring 69 is fixedly mounted at one end and is disposed around boss 63 biasing body member 57 into the position of FIG. 9 such that post 67 is against one end of slot 65.

Ends 61*a* and 59*a* of fingers 61, 59 project through respective openings 45, 43 of registration walls 11, 13 in the normal biased position of body member 57. When mailpiece "M" is pushed into the meter in a properly aligned orientation, edges 15, 17 of mailpiece "M" respectively contact ends 61*a*, 59*a* and force body member 57 to move in the direction of arrow "A". When edges 15, 17 are pushed against registration walls 11, 13, body member 57 will have moved in the direction of arrow "A" to a position where post 67 is now against the opposite side of slot 65 and end 71 of body member 57 has moved past sensor 27 such that body member 57 no longer blocks the through-beam of sensor 27 and printing is initiated.

In the event that mailpiece "M" is presented in a skewed manner such that only one of edges 15, 17 contact corresponding ends 61*a*, 59*a*, body member 57 will not move in the direction of arrow "A" but will be forced to pivot about pin 67 along arc "B—B". In this situation, sensor 27 will remain blocked by body member 57 to prevent initiation of printing on a skewed mailpiece "M".

One skilled in the art will readily recognize that the inventive apparatus offers advantages over the prior art in that it is easy to use and works independently of the mailpiece insertion direction. Moreover, additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims. For example, while an optical sensor has been shown, a hall effect sensor or a micro switch with cams could also be used in lieu thereof.

What is claimed is:

1. In a postage meter, an apparatus for ensuring proper registration of a mailpiece in a feed path of the postage meter prior to printing, the apparatus comprising:

a printing mechanism;

means for detecting first and second edges of the mailpiece in the feed path, said detecting means initiating printing by the printing mechanism on the mailpiece at times when the first and second edges are concurrently detected in the feed path by the detecting means and inhibiting printing by the printing mechanism at times when the first and second edges are not concurrently detected in the feed path by the detecting means, wherein the detecting means includes a sensor and first and second trip sensor arms each mounted for movement between a respective first position blocking the sensor and a respective second position not blocking the sensor;

wherein at times when the mailpiece is fed into the feed path such that it moves the first and second trip sensor arms from their respective first positions to their respective second positions, the sensor indicates that printing by the printing mechanism on the mailpiece is to be initiated.

2. An apparatus as set forth in claim 1, wherein the detecting means detects the first and second edges which are substantially perpendicular to each other.

3. An apparatus as set forth in claim 1, further comprising first and second biasing devices which respectively bias the first and second trip sensor arms into their respective first positions.

4. An apparatus as set forth in claim 1, wherein the first and second trip sensor arms are mounted to pivot between their respective first and second positions.

5. An apparatus as set forth in claim 1, wherein the first and second trip sensor arms are each flexible members having a fixed end and a free end such that the free end is moveable between the respective first and second positions.

6. In a postage meter, an apparatus for ensuring proper registration of a mailpiece in a feed path of the postage meter prior to printing, the apparatus comprising:

a printing mechanism;

means for detecting first and second edges of the mailpiece in the feed path, said detecting means initiating printing by the printing mechanism on the mailpiece at times when the first and second edges are concurrently detected in the feed path by the detecting means and inhibiting printing by the printing mechanism at times when the first and second edges are not concurrently detected in the feed path by the detecting means, wherein the detecting means includes a main body having means for permitting both a first type of movement and a second type of movement of the main body, and a sensor, and wherein at times when the mailpiece is fed into the feed path in a properly registered orientation it contacts and moves the main body in the first type of movement from a first position relative to the sensor whereby the sensor inhibits printing by the printing mechanism to a second position relative to the sensor causing the sensor to initiate printing and at times when the mailpiece is fed into the feed path in a non-registered orientation it contacts and moves the main body in the second type of movement from the first position to a third position relative to the sensor such that the sensor continues to inhibit printing by the printing mechanism.

7. An apparatus as set forth in claim 6, further comprising a biasing mechanism which biases the main body into the first position.

8. An apparatus as set forth in claim 7, wherein the first type of movement is a linear movement and the second type of movement is a pivoting movement.

9. An apparatus as set forth in claim 8, wherein the permitting means includes an elongated slot disposed in the main body and a fixed post disposed in the slot such that the linear movement is along the length of the elongated slot and the pivoting movement is about the fixed post.

10. An apparatus as set forth in claim 6, wherein the main body includes first and second fingers which project into the feed path, and at times when the mailpiece is fed into the feed path in the properly registered orientation it contacts both the first and second fingers and at times when the mailpiece is fed into the feed path in the non-registered orientation it contacts only one of the first and second fingers.

* * * * *